US008702442B2

(12) United States Patent
Debenedictis et al.

(10) Patent No.: US 8,702,442 B2
(45) Date of Patent: Apr. 22, 2014

(54) TELECOMMUNICATIONS CONNECTOR

(75) Inventors: Damon Francis Debenedictis, Castle Rock, CO (US); Bernard H. Hammond, Cheltanham (GB); Kavita Purohit, Mardi (AU)

(73) Assignee: ADC GmbH, Berlin (DE)

( * ) Notice: Subject to any disclaimer, the term of this patent is extended or adjusted under 35 U.S.C. 154(b) by 244 days.

(21) Appl. No.: 13/145,312

(22) PCT Filed: Jan. 8, 2010

(86) PCT No.: PCT/AU2010/000017
§ 371 (c)(1),
(2), (4) Date: Oct. 14, 2011

(87) PCT Pub. No.: WO2010/081186
PCT Pub. Date: Jul. 22, 2010

(65) Prior Publication Data

US 2012/0021636 A1 Jan. 26, 2012

(30) Foreign Application Priority Data

Jan. 19, 2009 (AU) ..... 2009900199

(51) Int. Cl.
*H01R 4/24* (2006.01)

(52) U.S. Cl.
USPC ..... 439/395

(58) Field of Classification Search
USPC ..... 439/395, 391, 404, 405, 82, 751
See application file for complete search history.

(56) References Cited

U.S. PATENT DOCUMENTS

| | | | | | |
|---|---|---|---|---|---|
| 5,074,804 | A | * | 12/1991 | Pantland et al. | 439/395 |
| 5,246,381 | A | * | 9/1993 | Tashiro et al. | 439/395 |
| 5,522,733 | A | * | 6/1996 | White et al. | 439/395 |
| 5,525,078 | A | * | 6/1996 | Springer | 439/607.38 |
| 5,645,445 | A | * | 7/1997 | Siemon et al. | 439/395 |
| 5,683,267 | A | * | 11/1997 | Ribbeck et al. | 439/395 |
| 5,759,061 | A | * | 6/1998 | Jensen et al. | 439/402 |
| 5,975,919 | A | * | 11/1999 | Arnett et al. | 439/82 |
| 6,050,842 | A | * | 4/2000 | Ferrill et al. | 439/404 |
| 6,077,128 | A | * | 6/2000 | Maag et al. | 439/751 |
| 6,093,048 | A | * | 7/2000 | Arnett et al. | 439/404 |
| 6,116,964 | A | * | 9/2000 | Goodrich et al. | 439/676 |
| 6,616,476 | B1 | * | 9/2003 | Moritz et al. | 439/404 |

(Continued)

FOREIGN PATENT DOCUMENTS

| | | |
|---|---|---|
| EP | 0 005 356 | 11/1979 |
| GB | 1 510 918 | 5/1978 |

OTHER PUBLICATIONS

International Search Report for International Application No. PCT/AU2010/000017 dated Mar. 21, 2010.

*Primary Examiner* — Amy Cohen Johnson
*Assistant Examiner* — Vladimir Imas
(74) *Attorney, Agent, or Firm* — Merchant & Gould P.C.

(57) ABSTRACT

An electrically conductive contact for electrically connecting an insulated conductor to an electrically conductive track of a printed circuit board, including bifurcate contact arms extending from a common section of the contact, an open end section of the contact arms being adapted to receive an end section of the insulated conductor, pierce the insulation and effect electrical connection therewith; and a fastener for electrically coupling the contact to the track of the printed circuit board, wherein the arms include torsion inhibitors for resiliently inhibiting movement of the arms about respective axes when the insulated conductor is forced therebetween.

29 Claims, 6 Drawing Sheets

(56) References Cited

U.S. PATENT DOCUMENTS

| | | | | |
|---|---|---|---|---|
| 7,044,807 | B2 * | 5/2006 | Furuno et al. | 439/751 |
| 7,052,328 | B2 * | 5/2006 | Ciezak et al. | 439/676 |
| 7,306,492 | B2 | 12/2007 | Clark et al. | |
| 7,335,049 | B2 * | 2/2008 | Alarcon et al. | 439/409 |
| 7,402,085 | B2 | 7/2008 | Hammond, Jr. et al. | |
| 7,413,484 | B2 * | 8/2008 | Fedder et al. | 439/751 |
| 7,473,135 | B1 | 1/2009 | Guo et al. | |
| 7,500,883 | B2 * | 3/2009 | Ciezak et al. | 439/676 |
| 7,604,515 | B2 * | 10/2009 | Siemon et al. | 439/676 |
| 7,695,307 | B2 * | 4/2010 | Mossner et al. | 439/404 |
| 7,736,173 | B2 * | 6/2010 | Chen | 439/395 |
| 7,789,716 | B2 * | 9/2010 | Fedder et al. | 439/751 |
| 7,980,899 | B2 * | 7/2011 | Siemon et al. | 439/676 |
| 8,092,262 | B1 * | 1/2012 | Frederick et al. | 439/751 |
| 8,133,069 | B2 * | 3/2012 | Hogue et al. | 439/404 |
| 8,142,236 | B2 * | 3/2012 | Fedder et al. | 439/751 |
| 8,157,600 | B2 * | 4/2012 | Ciezak et al. | 439/676 |
| 8,313,338 | B2 * | 11/2012 | Hogue et al. | 439/404 |
| 8,313,344 | B2 * | 11/2012 | Johnescu et al. | 439/571 |
| 2001/0018288 | A1 * | 8/2001 | Nicholls | 439/402 |
| 2002/0192997 | A1 | 12/2002 | Turek et al. | |
| 2003/0003810 | A1 * | 1/2003 | Jaouen | 439/676 |
| 2004/0067693 | A1 * | 4/2004 | Arnett | 439/676 |
| 2004/0077222 | A1 * | 4/2004 | AbuGhazaleh et al. | 439/676 |
| 2005/0106946 | A1 * | 5/2005 | Doorhy et al. | 439/676 |
| 2005/0250372 | A1 * | 11/2005 | Doorhy et al. | 439/404 |
| 2006/0014410 | A1 * | 1/2006 | Caveney | 439/188 |
| 2008/0050946 | A1 | 2/2008 | Nunokawa et al. | |
| 2008/0182460 | A1 * | 7/2008 | Fedder et al. | 439/862 |
| 2010/0087097 | A1 * | 4/2010 | Hogue et al. | 439/638 |
| 2011/0115494 | A1 | 5/2011 | Taylor et al. | |

* cited by examiner

TELECOMMUNICATIONS CONNECTOR

This application is a National Stage Application of PCT/AU2010/000017, filed 8 Jan. 2010, which claims benefit of Serial No. 2009900199, filed 19 Jan. 2009 in Australia and which applications are incorporated herein by reference. To the extent appropriate, a claim of priority is made to each of the above disclosed applications.

TECHNICAL FIELD OF THE INVENTION

The present invention relates to a telecommunications connector.

BACKGROUND OF THE INVENTION

In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

One prevalent type of communication system uses twisted pairs of wires to transmit signals. In twisted pair systems, information such as video, audio and data are transmitted in the form of balanced signals over a pair of wires. The transmitted signal is defined by the voltage difference between the wires.

Crosstalk can negatively affect signal integrity in twisted pair systems. Crosstalk is unbalanced noise caused by capacitive and/or inductive coupling between wires and a twisted pair system. The effects of crosstalk become more difficult to address with increased signal frequency ranges.

The effects of crosstalk also increase when transmission signals are positioned closer to one another. Consequently, communications networks include areas that are especially susceptible to crosstalk because of the proximity of the transmission signals. In particular, communications networks include connectors that bring transmission signals in close proximity to one another. For example, the contacts of traditional connectors (e.g., jacks and plugs) used to provide interconnections in twisted pair telecommunications systems are particularly susceptible to crosstalk interference.

To promote circuit density, the contacts of the jacks and the plugs are required to be positioned in fairly close proximity to one another. Thus, the contact regions of the jacks and plugs are particularly susceptible to crosstalk. Furthermore, certain pairs of contacts are more susceptible to crosstalk than others. For example, the first and third pairs of contacts in the modular plugs and jacks are typically most susceptible to crosstalk.

To address the problems of crosstalk, jacks have been designed with contact spring configurations adapted to reduce the capacitive coupling generated between the contact springs so that crosstalk is minimized. An alternative approach involves intentionally generating crosstalk having a magnitude and phase designed to compensate for crosstalk caused at the plug or jack. Typically, crosstalk compensation can be provided by manipulating the positioning of the contacts or leads of the jack or can be provided on a printed circuit board used to electrically connect the contact springs of the jack to insulation displacement contacts (IDCs) of the jack.

The telecommunications industry is constantly striving toward larger signal frequency ranges. As transmission frequency ranges widen, crosstalk becomes more problematic. Thus, there is a need for further development relating to crosstalk remediation.

It is generally desirable to overcome or ameliorate one or more of the above mentioned difficulties, or at least provide a useful alternative.

SUMMARY OF THE INVENTION

In accordance with the present invention, there is provided, an electrically conductive contact for electrically connecting an insulated conductor to an electrically conductive track of a printed circuit board, including:

(a) bifurcate contact arms extending from a common section of the contact, an open end section of the contact arms being adapted to receive an end section of the insulated conductor, pierce the insulation and effect electrical connection therewith; and (b) a fastener for electrically coupling the contact to the track of the printed circuit board, wherein the arms include torsion inhibitors for resiliently inhibiting movement of the arms about respective axes when the insulated conductor is forced therebetween.

Preferably, the torsion inhibitors include oppositely facing concave bends in the arms.

Preferably, the torsion inhibitors include "S" shaped bends in the arms.

Preferably, the fastener includes a lug extending in parallel with the arms away from the common said common section of the contact In accordance with another aspect of the invention, there is provided a telecommunications connector for electrically connecting insulated conductors of a first data cable with corresponding insulated conductors of a second data cable, including a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable, wherein the contacts include a torsion inhibitor for contact arms of the contacts.

In accordance with another aspect of the invention, there is provided a telecommunications connector for electrically connecting insulated conductors of a first data cable with corresponding insulated conductors of a second data cable, including:

(a) a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable; and (b) a screen connector for shielding contacts of the electrical connector from external electromagnetic interference, wherein the contacts include a torsion inhibitor for contact arms of the contacts.

Preferably, the screen connector includes an electrically conductive cable engaging member; an electrically conductive insulation displacement contact (IDC) member; and an electrically conductive socket member, the cable engaging member, the IDC member and the socket member being in electrical communication.

In accordance with another aspect of the invention, there is provided a telecommunications connector for electrically connecting insulated conductors of a first data cable with corresponding insulated conductors of a second data cable, including:

(a) a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable; and (b) a cap for shielding contacts from external electromagnetic interference, including a bridging section shaped to extend over the wire connection locations of the connector; and first and second lateral sections extending from respective sides of the bridging section in a common direction along respective sides of the connector, wherein the first lateral section lateral section extends further than the second lateral section, wherein the contacts include a torsion inhibitor for contact arms of the contacts.

Preferably, the bridging section includes a plurality of apertures over the wire connection locations.

Preferably, the cap is made of an electrically conductive material.

In accordance with another aspect of the invention, there is provided a screen connector for shielding contacts of the above described electrical connector from external electromagnetic interference, including:

(a) an electrically conductive cable engaging member;

(b) an electrically conductive insulation displacement contact (IDC) member; and (c) an electrically conductive socket member, wherein the cable engaging member, the IDC member and the socket member are in electrical communication.

In accordance with another aspect of the invention, there is provided a cap for shielding contacts of the above described electrical connector from external electromagnetic interference, including a bridging section shaped to extend over the wire connection locations of the connector; and first and second lateral sections extending from respective sides of the bridging section in a common direction along respective sides of the connector, wherein the first lateral section lateral section extends further than the second lateral section.

In accordance with another aspect of the invention, there is provided a telecommunications patch panel including a plurality of the above described connectors.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
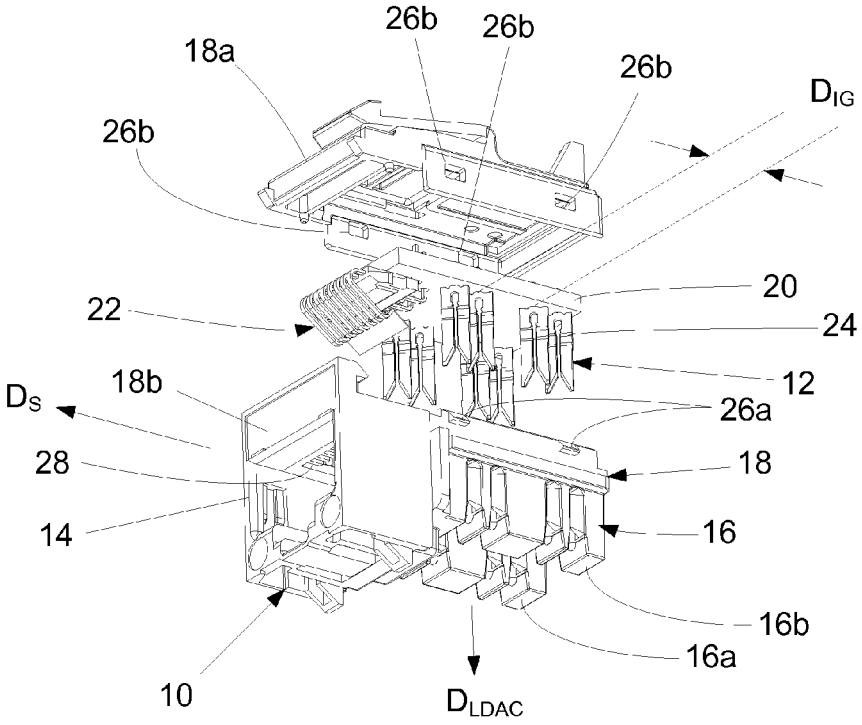
FIG. 1 is an exploded perspective view of an electrical connector.
Figure 2:
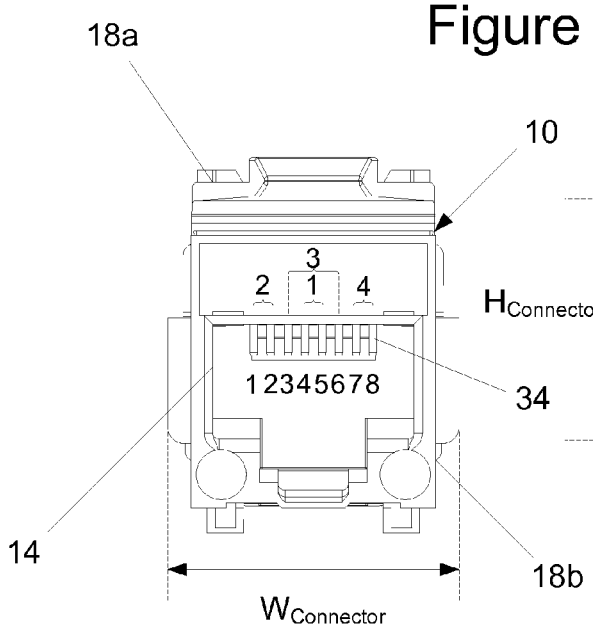
FIG. 2 is a front view of the connector shown in FIG. 1.
Figure 3:
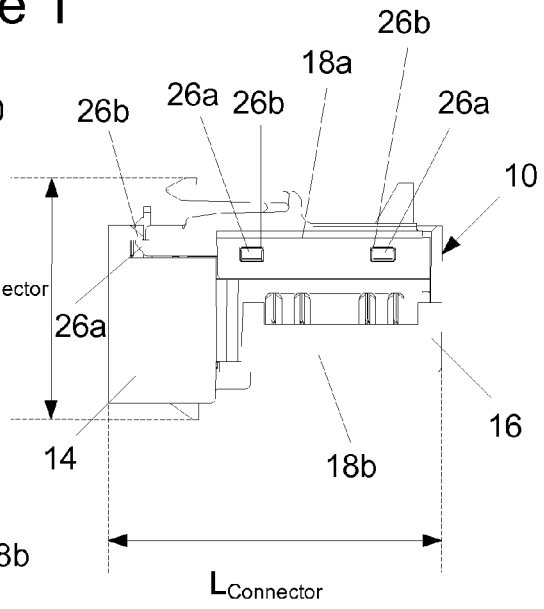
FIG. 3 is a side view of the connector shown in FIG. 1.

The electrical connector 10 shown in FIGS. 1 to 3 is used to electrically connect insulated conductors of a first data cable (not shown) to corresponding insulated conductors of a second data cable (also not shown). The connector 10 includes a plurality of electrically conductive contacts 12 extending between a socket 14 that is shaped to at least partially receive a plug that terminates the insulated conductors of the first data cable, and a plurality of wire connection locations 16 for at least partially receiving respective ones of the insulated conductors of the second data cable.

The connector 10 includes a housing 18 formed in top and bottom parts 18*a*, 18*b* that couple together to encapsulate the electrically conductive contacts 12 therebetween. The contacts 12 include electrically conductive leads (not shown) on a printed circuit board (PCB) 20 that electrically connect contact springs 22 arranged for engagement with corresponding contacts of the plug when seated in the socket 14, to corresponding insulation displacement contacts (IDCs) 24 seated in the wire connection locations 16.

The housing 18 and the contacts 12 are described in further detail below.

1. Housing

The housing 18 is configured as a right angled jack, where the socket 14 opens in a direction $D_S$ which is normal to a lengthwise direction $D_{LDAC}$ of the arms of the contacts 24. The connector 10 has an overall size advantage over the current Copper Ten and TrueNet KM8 jacks. With reference to FIGS. 2 and 3, the connector 10 has the following dimensions:

a. Width=$W_{Connector}$=17.60 mm;

b. Height=$H_{Connector}$=22.50 mm; and c. Length=$L_{Connector}$=32.00 mm.

The connector 10 has a reduced form factor and is adapted for use with 1RU 48 Port and 2RU 72-port patch panels for higher density data centre solutions. The reduced form factor being the overall size of the connector 10, especially the width, which matters for the density of the patch panel. The smaller for factor provides higher density face plate and surface mount box solutions.

As above mentioned, the housing 18 for the connector 10 is formed in top and bottom parts 18*a*, 18*b* that couple together to encapsulate the electrically conductive contacts 12 therebetween. The bottom part 18*b* of the housing 18 includes the socket 14 and the wire connection locations 16 formed as a single piece. The top part 18*a* is formed as a closing piece shaped to overlie and couple to the bottom part 18*b*. The parts 18*a*, 18*b* are secured together by male and female interlocking fasteners 26*a*, 26*b* in the manner shown in FIGS. 1 and 3.

Having the socket 14 and wire connection locations 16 formed as a single piece 18*b* improves the structural strength of the connector 10 when compared with using a separate socket. Further, when the plug is inserted, it avoids the tilting and dislocation of the plug from the contact springs 22 which otherwise could be a possibility. Cost reduction on tooling for the plastic components is also achieved as well as reduced assembly time.

The connector 10 is preferably an RJ 45 connector. The socket 14 preferably conforms to the requirements for the standardised physical network interface, with regard to construction and wiring pattern, for the RJ 45 connector 10. The physical connectors that Registration Jacks use are of the modular connector type. The connector 10 is hereafter described, by way of non-limiting example, with reference to an RJ 45 connector 10.

The wire connection locations 16 include two parallel rows 16*a*, 16*b* of insulation displacement contact slots 28. Each row 16*a*, 16*b* of wire connection locations includes two pairs of insulation displacement contact slots 28 for receiving, effecting electrical connection with, two corresponding twisted pairs of insulated conductors (not shown).

2. Contacts

Figure 4:
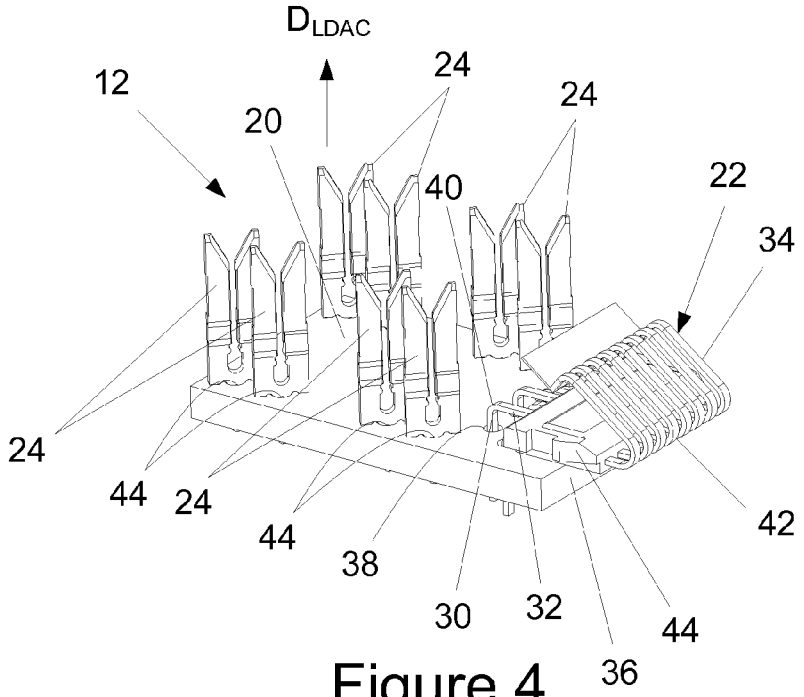
FIG. 4 is a perspective view of the contacts of the connector shown in FIG. 1.
Figure 5A:
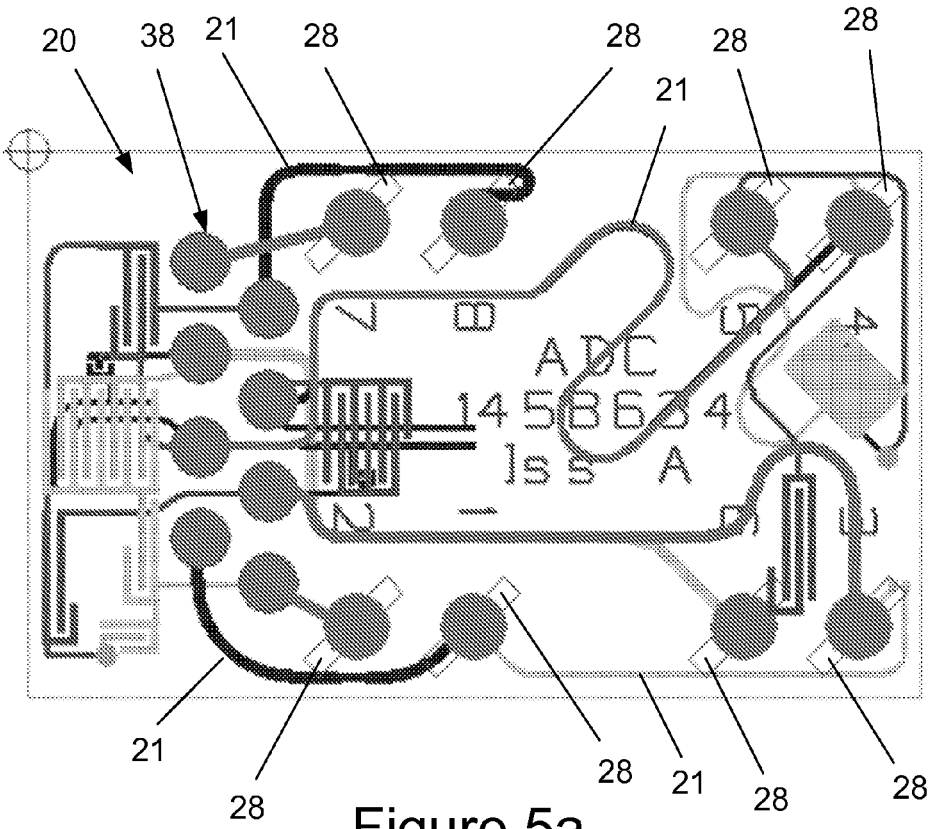
FIG. 5*a* is a plan view of a printed circuit board of the connector shown in FIG. 1.

As particularly shown in FIGS. 4 and 5*a*, the contacts 12 include electrically conductive leads 21 mounted on the PCB 20 that electrically connect contact springs 22 arranged for engagement with corresponding contacts of the plug when seated in the socket 14, to corresponding insulation displacement contacts (IDCs) 24 seated in the insulation displacement contact slots 28. A detailed description of each one of these sections of the contacts is set out below.

a. Contact Springs

The contact springs 22 include the following sections joined by elbows:

i. A PCB engaging section 30;

ii. A compensation section 32; and iii. A plug engaging section 34.

i. PCB Engaging Section

A socket end 36 of the PCB 20 includes a row of contact spring termination apertures 38 shaped to receive terminal end sections of the PCB engaging sections 30 of the contact springs 22. The apertures 38 are electrically connected to corresponding leads 21 of the PCB 20. As such, the contact springs 22 are electrically coupled to corresponding leads 21 when soldered into corresponding apertures 38, for example. The PCB engaging sections 30 extend in parallel out of the apertures 38 in the socket end section 36 of the PCB 20 in, a direction that is normal to the plane of the PCB 20, towards respective PCB elbow bends 40.

ii. Compensation Section 32

The compensation sections 32 of the contact springs 22 extend in parallel over the surface of the PCB 20, from the PCB elbow bends 40 towards socket elbow bends 42 which change the direction of the contact springs 22 so as to extend back over the PCB 20.

The compensation sections 32 of the contact springs 22 are coupled to an integrated circuit 44 which is adapted to reduce cross-talk by compensating for capacitive and inductive coupling generated between the contact springs 22.

iii. Plug Engaging Section

The plug engaging section 34 of the contact springs 22 includes eight parallel contacts that extend from the socket elbows 42 into corresponding recesses 28 in the socket 14 for engagement with corresponding contacts of the plug. As particularly shown in FIG. 2, the contact springs 22 are labelled as having positions 1 to 8. In accordance with the RJ 45 standard, the contact springs are formed in the following pairs:

i. Pair 1=Contact springs 4 & 5;

ii. Pair 2=Contact springs 1 & 2;

iii. Pair 3=Contact springs 3 & 6; and iv. Pair 4=Contact springs 7 & 8.

The insulated conductors of the first data cable are electrically connected to corresponding contacts of the end section of the plug. As such, the insulated conductors of the first data cable are electrically connected to corresponding contacts 22 of the connector 10 when the plug is seated in the socket 14 and the contacts of the plug resiliently bear against corresponding contacts 22 of plug engaging section 34 of the connector 10. The plug engaging section 34 preferably includes Bel Stewart contacts.

b. Leads

As above-described, the PCB 20 includes electrically conductive leads 21, also referred to as tracks, that electrically connect insulation displacement contacts 24 seated in the wire connection locations 16 to corresponding contact springs 22.

The connector 10 uses a combination of capacitive coupling in the connector 10 as supplied on the flex circuit, and capacitive compensation on the PCB 20. The flex includes primary compensation for the 12-36, 36-45, and 36-78 pairs. Secondary compensation is included on the 36-78 pair on the PCB 20. A secondary compensation and an additional 3rd compensation for the 36-45 is included on the PCB 20. Primary compensation for the 12-45, 12-78, and 45-78 is provided on the PCB 20. In addition to these, a combination of track length and impedance as well as a capacitive plate are included on the 45 pair to compensate for return loss on that pair such that the return loss at 500 MHz is improved.

Figure 5B:
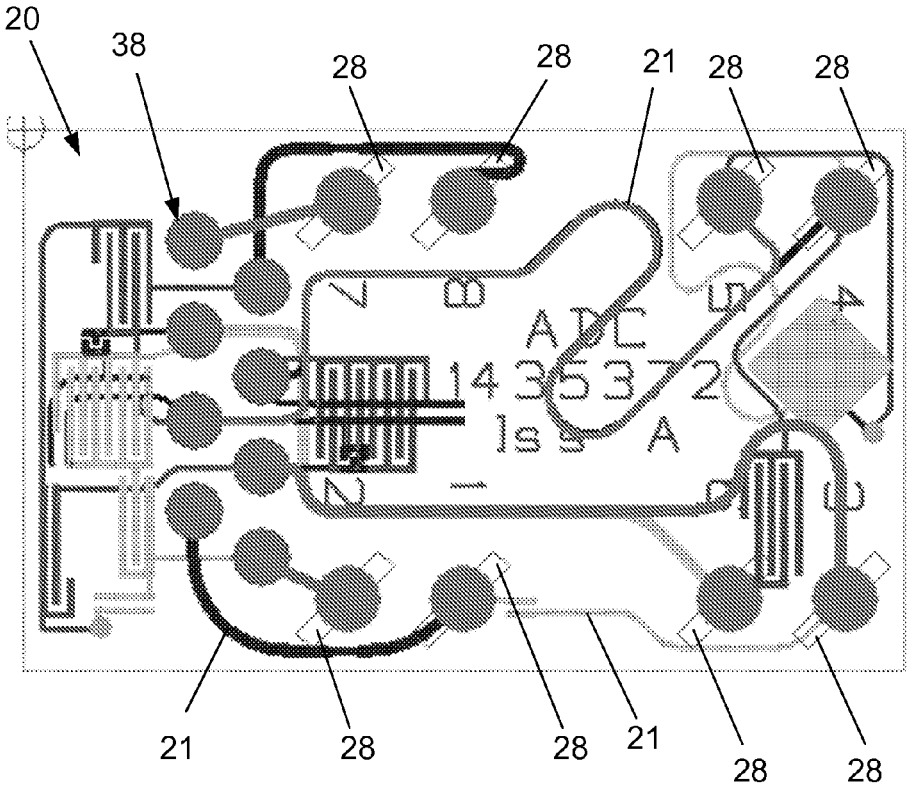
FIG. 5*b* is a plan view of another printed circuit board of the connector shown in FIG. 1.

The PCB 20 shown in FIG. 5*a* is used in the shielded connector 100, which is described in further detail below. The alternative PCB 20 shown in FIG. 5*b* is used in the unshielded connector 200, which is also described in further detail below.

As also above described, a socket end 36 of the PCB 20 includes a row of contact spring termination apertures 38 shaped to receive terminal end sections of the PCB engaging sections 30 of the contact springs 22. The PCB 20 also includes four pairs of IDC apertures 44 shaped to receive terminal end sections of IDCs 24. The pairs of apertures 44 are located on the PCB 20 in positions that properly align the IDCs with corresponding wire connection locations 16, also referred to as "insulation displacement contact slots" 16. The apertures 44 are electrically connected to corresponding leads. As such, the IDCs 24 are electrically coupled to corresponding leads when soldered into apertures 44, for example. The IDCs 24 extend in parallel out of the apertures 44 in the PCB 20, in a direction that is normal to the plane of the PCB 20.

c. IDCs

Figure 6:
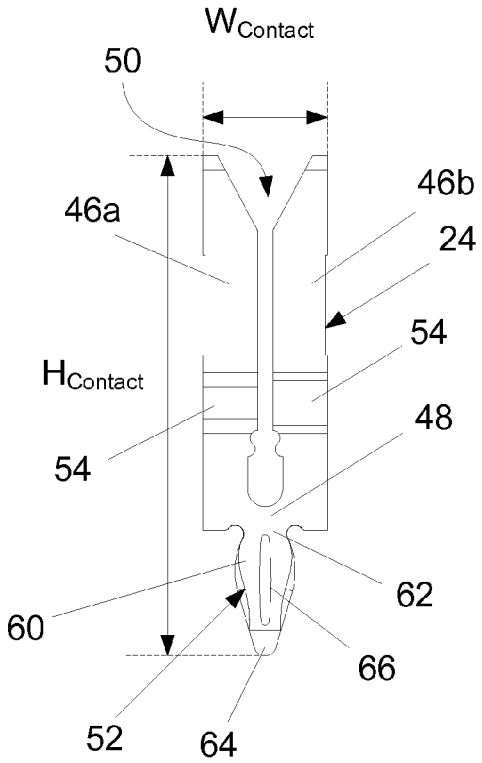
FIG. 6 is a front view of a contact of the connector shown in FIG. 1.
Figure 7:
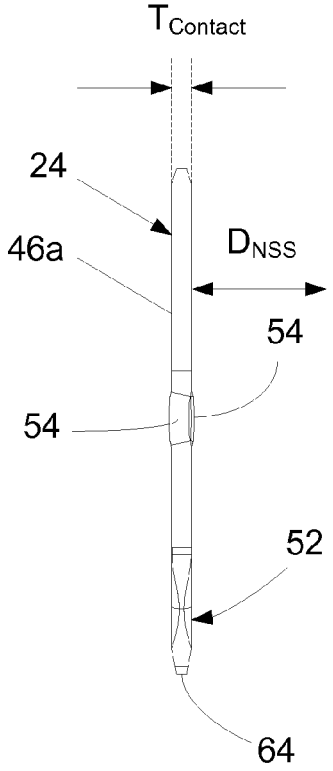
FIG. 7 is a side view of the contact shown in FIG. 6.

As particularly shown in FIGS. 6 and 7, each contact 12 includes bifurcate contact arms 46*a*, 46*b* extending from a common section 48 on the contact 24. An open end section 50 of the contact arms 46*a*, 46*b* is adapted to receive an end section of the insulated conductor 56, in the manner shown in FIGS. 8 and 9, pierce the insulation and effect electrical connection therewith. The contact 24 also includes a fastener 52 for electrically coupling the contact 24 to a corresponding aperture 44 of the printed circuit board 20. The arms 46*a*, 46*b* of the contact 24 include torsion inhibitors 54 for resiliently inhibiting movement of the arms 46*a*, 46*b* about respective axes $A_{LDA1}$ and $A_{LDA2}$.

Figure 8:
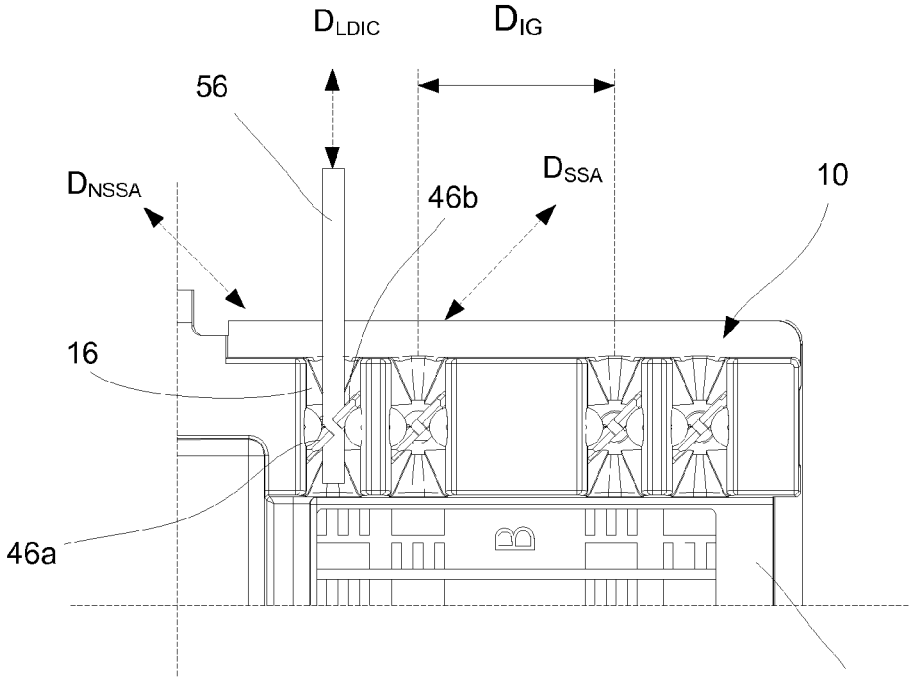
FIG. 8 is an enlarged view of a section of the connector shown in FIG. 1 coupled to an insulated conductor.

As particularly shown in FIG. 8, the insulation displacement contact slots 16 lay open the arms 46*a*, 46*b* of the contacts 24 so that a side to side direction $D_{SSA}$ of each arm is approximately 45 degrees to the lengthwise direction $D_{LDIC}$ of the insulated conductor 56. Distal ends of the arms include opposed angled chamfer cutting surfaces 58. The angled surfaces 58 are laid open in a corresponding insulation displacement contact slot 16 so as to receive an end of an insulated conductor 56 therebetween.

Figure 9:
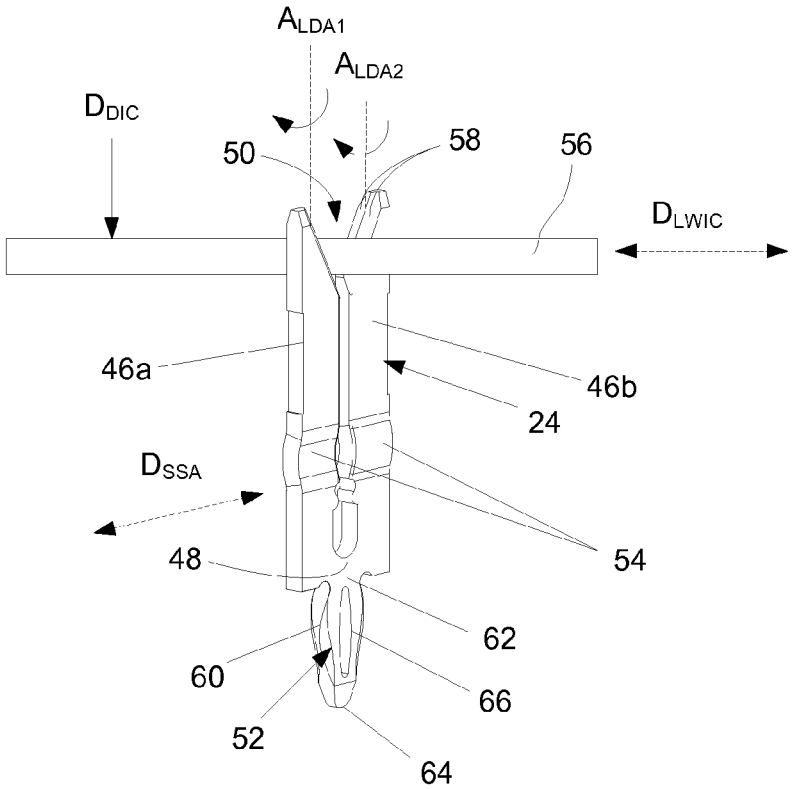
FIG. 9 is a front perspective view of the contact shown in FIG. 6 coupled to an insulated conductor.

With reference to FIG. 9, as the wire 56 is forced into the slot open end 50 of the contact 24 in direction "$D_{DIC}$", the angled chamfer surfaces 58 engage and pierce the insulation of the wire 56 and resiliently engage and bear against the conductor. The bifurcate arms 46*a*, 46*b* of the insulation displacement contact 24 thereby form an electric connection with the insulated conductor. As a result of the contact arms 46*a*, 46*b* being arranged at an angle of 45 degrees to the lengthwise direction $D_{LDIC}$ of the insulated conductor 56, the arms 46*a*, 46*b* have a tendency to rotate about respective axes $A_{LDA1}$ and $A_{LDA2}$ as the insulated conductor 56 is forced downwardly therebetween.

The torsion inhibitors 54 include oppositely facing concave bends in the arms. The torsion inhibitors 54 are resiliently deformable and act against any torsion experienced as a result of the arms 46*a*, 46*b* rotating about their axes $A_{LDA1}$ and $A_{LDA2}$ as the insulated conductor 56 is forced therebetween in the manner shown in FIG. 8. The torsion inhibitors 54 also inhibit relative movement of the arms 46*a*, 46*b* in a direction $D_{NSSA}$ normal to the side to side direction of the arms.

The torsion inhibitors 54 help to reduce stresses that are developed while inserting the wires 56 for terminating as well as apply a spring loaded effect to grip the wire 56 enough after several re-terminations. The IDC 24 has been successfully tested for 200 re-terminations for the range of stranded and solid wires 22 AWG-26 AWG and for double terminations and 200 re-terminations for 25-26 AWG wire diameters. American Wire Gauge—(AWG) is a U.S. standard set of non-ferrous wire conductor sizes. Typical household wiring is AWG number 12 or 14. Telephone wire is usually 22, 24, or 26. The higher the gauge number, the smaller the diameter and the thinner the wire.

Alternatively, the torsion inhibitors 54 include "S" shaped bends in the arms. Otherwise, the contact includes any other suitable means for inhibiting torsion.

The fastener 52 includes a lug 60 extending in parallel with the arms 46*a*, 46*b* away from the common section 58 of the contact 24. The lug 60 is shaped for engagement with a corresponding recess 44 in the printed circuit board 20. The lug 60 is flared out from a neck 62 extending from the common section 48 and is tapered to a tip end section 64.

As particularly shown in FIG. 7, top and bottom sides of the lateral sections of the lug 60 include oppositely facing bevelled surfaces. Top and bottom sides of the distal end of the lug 60 include oppositely facing angled chamfer surfaces which form the pointed tip 64.

The lug 60 also includes a slot 66 extending from the neck 62 to the angled chamfer surfaces of the tip 64. The slot 66 reduces stress in the side to side direction $D_{SSA}$ of the contact 24.

The IDCs 24 have been designed with reduced size to reduce the overall size of the connector 10. The IDCs 24 have the following dimensions:

i. Width=$W_{Contact}$=2.5 mm;
ii. Length=$L_{Contact}$=10 mm; and
iii. Thickness=$T_{Contact}$=0.4 mm.

When compared with the existing Copper Ten and TrueNet KM8 IDC design, the new contacts 24 are made:

i. The width ($W_{Contact}$) is reduced by about 34%;
ii. The height ($H_{Contact}$) is reduced by about 20%; and
iii. The thickness ($T_{Contact}$) is also reduced from 0.5 mm (which is for all existing IDCs) to 0.4 mm to reduce stiffness.

The insulation displacement contacts 24 are preferably made of Wieland S23 material.

The reduced size of the IDCs 24 increases the isolation gaps $D_{IG}$ between adjacent pairs of IDCs when compared to previous contacts. This reduces crosstalk between adjacent pairs.

The reduced size of the IDCs 24 reduces the overall form factor of the connector 10 so that higher density patch panels can be configured using a plurality of the connector 10*s*.

Shielded and Unshielded.

Figure 10:
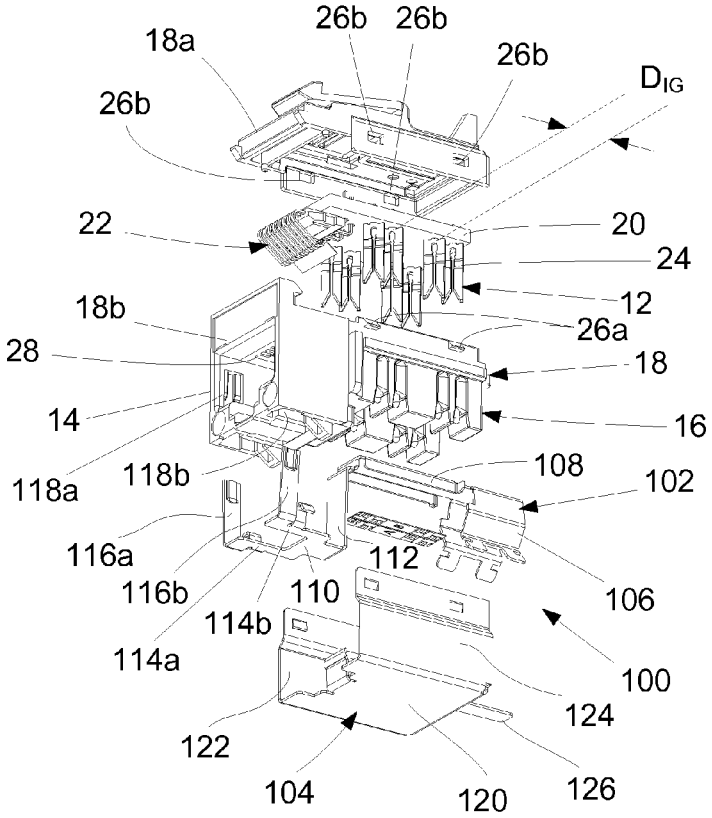
FIG. 10 is an exploded perspective view of another electric connector.
Figure 11:
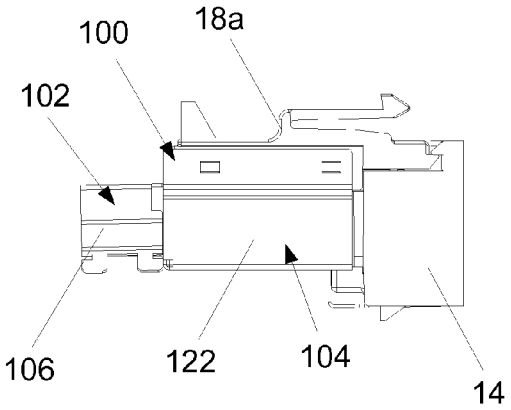
FIG. 11 is a side view of the connector shown in FIG. 9.
Figure 12:
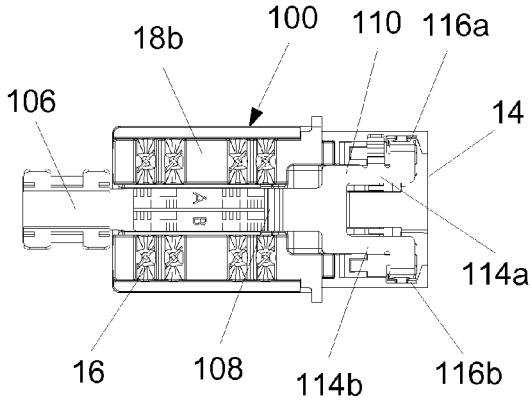
FIG. 12 is a bottom view of the connector shown in FIG. 9 with the back can removed.

The connector 10 can be adapted to be used as a shielded connector 100, as shown in FIGS. 10 to 12, or an unshielded connector 200, as shown in FIG. 12. The user can convert between shielded and unshielded connectors 100, 200 to suit the needs of a particular application.

1. Shielded Connector

The shielded connector 100 shown in FIGS. 10 to 12 has been designed to improve transmission performance. The connector 100 supports 10 Gig transmission speeds and meets the Cat 6a requirements.

The shielded connector 100 and the connector 10 operate in an analogous manner and include common components. Like numerals have been used to reference parts common to both connectors 10, 100. As above-mentioned, the connector 100 includes the PCB 20 shown in FIG. 5*a*.

The improvement in transmission performance is achieved through the addition of:

a. A screen connector 102;
b. A back can 104; and
c. A printed circuit board 20 that has been tuned for use with the shielded connector 100.

The screen connector 102 and the back can 104 are preferably made of 0.3 mm thick phosphor bronze plated 5 to 8 μm Sn W/Ni under layer over copper.

a. Screen Connector

The screen connector 102 can be fitted or removed independently after the whole connector 100 assembly is done. Whereas in the Cat 5E jacks the socket, turret and closing piece are separate parts and the screen connector has to go in the socket before the turret and the closing piece are assembled.

The screen connector 102 includes the following parts electrically coupled together:

i. A cable engaging member 106;
ii. An IDC member 108; and
iii. A socket member 110.

The cable engaging member 106 is a tubular member that is adapted to wrap around a lateral end section of the second data cable (not shown). The cable engaging member 106 includes a fastener which, in one condition of use, lays the member 106 open for engagement with a lateral section of a data cable, and, in another condition of use, closes the member around the lateral end section of the cable. The fastener includes interlocking male and female recesses and bosses.

The cable engaging member 106 is electrically coupled to the IDC member 108 which is shaped to overlie a gap between the two rows 16*a*, 16*b* of wire connection locations 16. The IDC member 108 is coupled to the socket member 110 by an electrically conductive bridging piece 112.

The socket member 110 includes two bifurcate arms 114*a*, 114*b* extending from a neck section that is coupled to the bridging piece 112. The arms 114*a*, 114*b* include transverse members 116*a*, 116*b* that extend normal to the length wise direction of the arms into respective recesses 118*a*, 118*b* formed in the socket 14.

The cable engaging member 106, the IDC member 108 and the socket member 110 are preferably made from a single sheet of material.

b. Back Can

The back can 104 is generally shaped to fit over and around the insulation displacement contact slots 16. To facilitate this, the back can 104 includes a capping member 120 and two lateral members 122, 124. The capping member 120 is shaped to fit over the insulation displacement contact slots 16 and the lateral members a shaped to contour the sides 122, 124 of the wire connection locations 16.

The back can 104 includes a tail member 126 shaped to extend over the cable engaging member 106 of the screen connector 102 so that the tubular member 106 is shielded when arranged in the open condition of use.

2. Unshielded Connector

Figure 13:
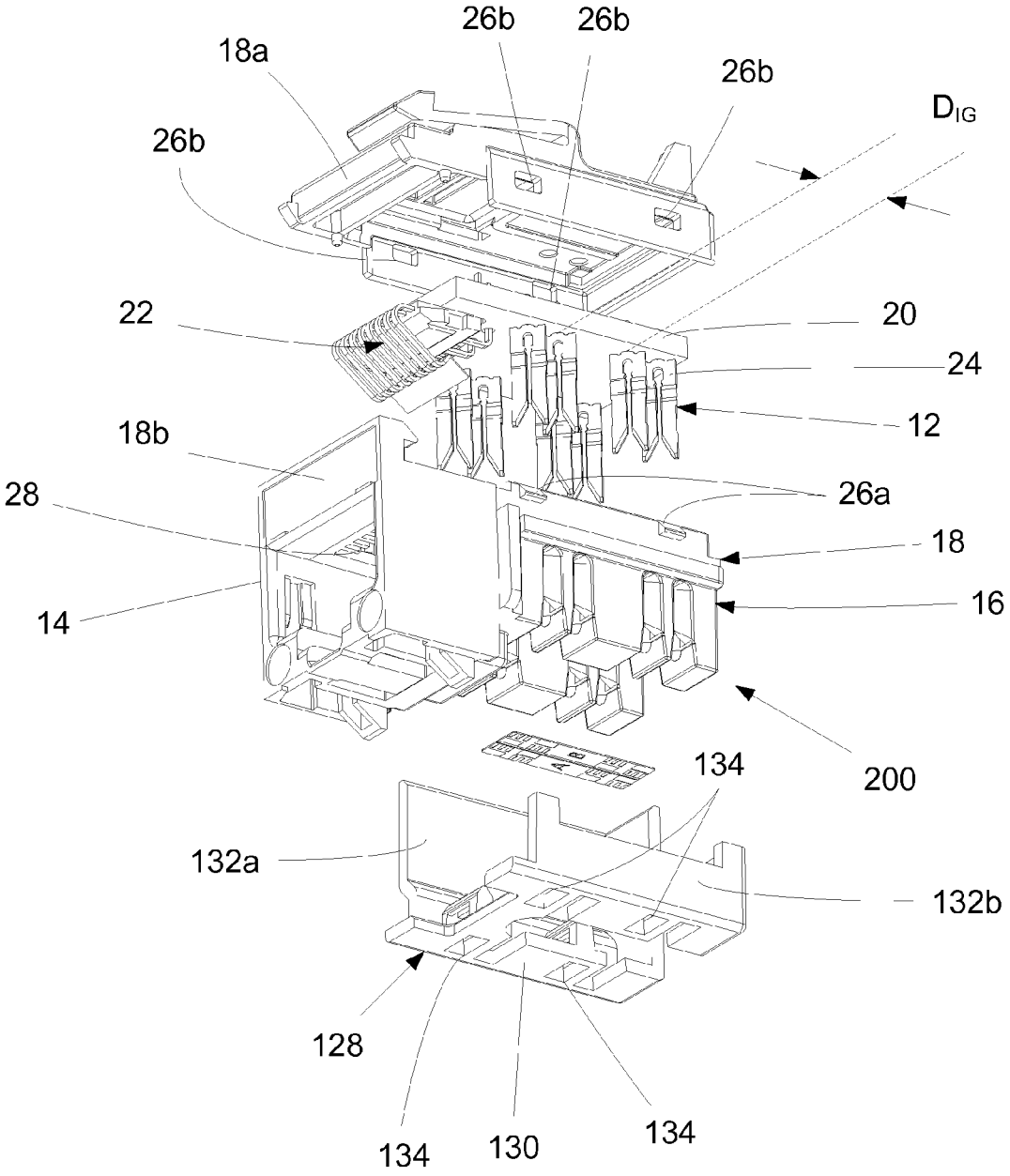
FIG. 13 is an exploded perspective view of another electric connector.

The unshielded connector 200 shown in FIG. 13 has been designed for unshielded transmission. The unshielded connector 200 and the connector 10 operate in an analogous manner and include common components. Like numerals have been used to reference parts common to both connectors 10, 200. As above-mentioned, the connector 100 includes the PCB 20 shown in FIG. 5*a*.

The unshielded connector 200 includes a shielding cap 128 and a printed circuit board 20 that has been tuned for use with the unshielded connector 10.

The cap 128 is designed to shield contacts 12 of the electrical connector 200 from external electromagnetic interference. The cap 128 includes a bridging section 130 shaped to extend over the wire connection locations 16 of the connector 200; and first and second lateral sections 132*a*, 132*b* extending from respective sides of the bridging section 130 in a common direction along respective sides of the connector 200. The first lateral section lateral 132*a* section extends further than the second lateral section 132*b*. The lateral sections 132*a*, 132*b* are arranged in this manner for greater density of side by side connectors 200.

The bridging section 130 includes a plurality of apertures 134 over the wire connection locations 16.

The cap 128 is plastic that includes steel fibres to act as a shield for alien crosstalk. Material used for unshielded cap 128:

Faradex—DS00361P Gydknat—0-25

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

LIST OF PARTS

10 Connector
12 Contacts
14 Socket
16 Wire connection locations
16*a*, 16*b* Row of wire connection locations
18 Housing
18*a*, 18*b* Upper and lower parts of housing
20 Printed circuit board
21 Lead
22 Contact springs
24 Insulation displacement contact
26*a*, 26*b* Male and female interlocking parts
28 Recess in socket
30 PCB engaging section
32 Compensation section
34 Plug engaging section
36 Socket end of PCB
38 Aperture
40 Elbow
42 Elbow
44 Aperture
46*a*, 46*b* Bifurcate contact arms
48 Common section of contact
50 Open end section of contact
52 Fastener
54 Torsion inhibitor
56 Insulated conductor
58 Chamfer cutting surface;
60 Lug
62 Neck
64 Tip end section
66 Slot
100 Shielded connector
102 Screen connector
104 Back can
106 Cable engaging member
108 IDC member
110 Socket member
112 Bridging piece
114*a*, 114*b* Bifurcate arm
116*a*, 116*b* Transverse member
118*a*, 118*b* Recess
120 Capping member
122 Lateral member
124 Lateral member
126 Tail member
128 Shielding cap
130 Bridging section
132*a* First lateral section
132*b* Second lateral section
134 Apertures
200 Unshielded connector

The invention claimed is:

1. An electrically conductive contact for electrically connecting an insulated conductor to an electrically conductive track of a printed circuit board, comprising:

(a) bifurcate contact arms extending from a common section of the contact, an open end section of the contact arms being adapted to receive an end section of the insulated conductor, pierce the insulation and effect electrical connection therewith; and (b) a fastener for electrically coupling the contact to the track of the printed circuit board, the arms including torsion inhibitors that resiliently inhibit movement of the arms about respective axes when the insulated conductor is forced therebetween, the torsion inhibitors including oppositely facing concave bends in the arms, each concave bend having opposite first and second ends in line with the contact arms.

2. The contact claimed in claim 1, wherein the concave bends in the arms include "S" shaped bends in the arms.

3. The contact claimed in claim 1, wherein the fastener includes a lug extending in parallel with the arms away from the common section of the contact.

4. The contact claimed in claim 3, wherein the lug is shaped for engagement with a corresponding recess in the printed circuit board.

5. The contact claimed in claim 3, wherein the lug is flared out from a neck extending from said common section.

6. The contact claimed in claim 5, wherein the lug is tapered to a tip end section.

7. The contact claimed in claim 4, wherein the lug includes a slot extending between the said common section and a tip end section.

8. The contact claimed in claim 7, wherein the slot reduces stress in said common section as a result of relative movement between the arms.

9. The contact claimed in claim 1, wherein the contact is substantially 2.5 mm wide, 10 mm long, and 0.4 mm thick.

10. A telecommunications connector for electrically connecting insulated conductors of a first data cable with corresponding insulated conductors of a second data cable, comprising:

a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable, the plurality of electrically conductive contacts comprising:

(a) bifurcate contact arms extending from a common section of the contact, an open end section of the contact arms being adapted to receive an end section of the insulated conductor, pierce the insulation and effect electrical connection therewith, and (b) a fastener for electrically coupling the contact to the track of the printed circuit board, the arms including torsion inhibitors that resiliently inhibit movement of the arms about respective axes when the insulated conductor is forced therebetween, the torsion inhibitors including oppositely facing concave bends in the arms, each concave bend having opposite first and second ends in line with the contact arms, wherein the plurality of electrically conductive contacts open into said wire connection locations.

11. A telecommunications connector for electrically connecting insulated conductors of a first data cable with corresponding insulated conductors of a second data cable, comprising:

(a) a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable; and (b) a screen connector for shielding contacts of the electrical connector from external electromagnetic interference, the plurality of electrically conductive contacts comprising:

(1) bifurcate contact arms extending from a common section of the contact, an open end section of the contact arms being adapted to receive an end section of the insulated conductor, pierce the insulation and effect electrical connection therewith, and (2) a fastener for electrically coupling the contact to the track of the printed circuit board, the arms including torsion inhibitors that resiliently inhibit movement of the arms about respective axes when the insulated conductor is forced therebetween, the torsion inhibitors including oppositely facing concave bends in the arms, each concave bend having opposite first and second ends in line with the contact arms, wherein the plurality of electrically conductive contacts open into said wire connection locations.

12. The connector claimed in claim 11, wherein the screen connector includes an electrically conductive cable engaging member; an electrically conductive insulation displacement contact (IDC) member; and an electrically conductive socket member, the cable engaging member, the IDC member and the socket member being in electrical communication.

13. The connector claimed in claim 12, wherein the cable engaging member is a concave tube shaped to receive a laterally receive a lateral terminal end section of the second data cable.

14. The connector claimed in claim 12, wherein the IDC member is shaped to overlie a gap between two rows of wire connection locations of the connector.

15. The connector claimed in claim 12, wherein the socket connector includes bifurcate contact arms extending into the socket of the connector.

16. The connector claimed in claim 12, wherein the shield is made of phosphor bronze plated 5 to 8 μm Sn W/Ni under layer over copper.

17. A telecommunications connector for electrically connecting insulated conductors of a first data cable with corresponding insulated conductors of a second data cable, comprising:

(a) a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable; and (b) a cap for shielding contacts from external electromagnetic interference, including a bridging section shaped to extend over the wire connection locations of the connector; and first and second lateral sections extending from respective sides of the bridging section in a common direction along respective sides of the connector, wherein the first lateral section extends further than the second lateral section, the plurality of electrically conductive contacts comprising:

(1) bifurcate contact arms extending from a common section of the contact, an open end section of the contact arms being adapted to receive an end section of the insulated conductor, pierce the insulation and effect electrical connection therewith; and (2) a fastener for electrically coupling the contact to the track of the printed circuit board, wherein the arms include torsion inhibitors for resiliently inhibiting movement of the arms about respective axes when the insulated conductor is forced therebetween, wherein the plurality of electrically conductive contacts open into said wire connection locations.

18. The connector claimed in claim 17, wherein the bridging section include a plurality of apertures over the wire connection locations.

19. The connector claimed in claim 17, wherein the cap is made of an electrically conductive material.

20. The connector claimed in claim 17, wherein the torsion inhibitors include oppositely facing concave bends in the arms, each concave bend having opposite first and second ends in line with the contact arms.

21. A screen connector for shielding contacts of an electrical connector from external electromagnetic interference, comprising:

(a) an electrically conductive cable engaging member;

(b) an electrically conductive insulation displacement contact (IDC) member; and (c) an electrically conductive socket member, wherein the cable engaging member, the IDC member and the socket member are in electrical communication, and wherein the screen connector shields a plurality of electrically conductive contacts from external electromagnetic interference, the plurality of electrically conductive contacts comprising:

(1) bifurcate contact arms extending from a common section of the contact, an open end section of the contact arms being adapted to receive an end section of the insulated conductor, pierce the insulation and effect electrical connection therewith, and (2) a fastener for electrically coupling the contact to the track of the printed circuit board, the arms including torsion inhibitors that resiliently inhibit movement of the arms about respective axes when the insulated conductor is forced therebetween, the torsion inhibitors including oppositely facing concave bends in the arms, each concave bend having opposite first and second ends in line with the contact arms.

22. The screen connector claimed in claim 21, wherein the cable engaging member is a concave tube shaped to receive a laterally receive a lateral terminal end section of the second data cable.

23. The screen connector claimed in claim 21, wherein the IDC member is shaped to overlie a gap between two rows of wire connection locations of the connector.

24. The screen connector claimed in claim 21, wherein the socket connector includes bifurcate contact arms extending into the socket of the connector.

25. A cap for shielding contacts of the electrical connector from external electromagnetic interference, comprising:

a bridging section shaped to extend over the wire connection locations of the connector; and first and second lateral sections extending from respective sides of the bridging section in a common direction along respective sides of the connector, wherein the first lateral section extends further than the second lateral section, the cap shielding a plurality of electrically conductive contacts from external electromagnetic interference, the plurality of electrically conductive contacts comprising:

(a) bifurcate contact arms extending from a common section of the contact, an open end section of the contact arms being adapted to receive an end section of the insulated conductor, pierce the insulation and effect electrical connection therewith, and (b) a fastener for electrically coupling the contact to the track of the printed circuit board, the arms including torsion inhibitors that resiliently inhibit movement of the arms about respective axes when the insulated conductor is forced therebetween, the torsion inhibitors including oppositely facing concave bends in the arms, each concave bend having opposite first and second ends in line with the contact arms.

26. The cap claimed in claim 25, wherein the bridging section include a plurality of apertures over the wire connection locations.

27. The cap claimed in claim 25, wherein the cap is made of an electrically conductive material.

28. A telecommunications patch panel at which insulated conductors of a first data cable are electronically connected to corresponding insulated conductors of a second data cable, the telecommunication patch panel comprising:

(a) a plurality of electrically conductive contacts extending between a socket that is shaped to at least partially receive a plug that terminates the insulated conductors of the first data cable, and (b) a plurality of wire connection locations for at least partially receiving respective ones of the insulated conductors of the second data cable, the plurality of electrically conductive contacts comprising:

(1) bifurcate contact arms extending from a common section of the contact, an open end section of the contact arms being adapted to receive an end section of the insulated conductor, pierce the insulation and effect electrical connection therewith, and (2) a fastener for electrically coupling the contact to the track of the printed circuit board, the arms including torsion inhibitors that resiliently inhibit movement of the arms about respective axes when the insulated conductor is forced therebetween, the torsion inhibitors including oppositely facing concave bends in the arms, each concave bend having opposite first and second ends in line with the contact arms, wherein the plurality of electrically conductive contacts open into said wire connection locations.

29. A telecommunications connector for electrically connecting insulated conductors of a first data cable with corresponding insulated conductors of a second data cable, comprising:

(a) a plurality of electrically conductive contacts extending between a socket that is shaped to at least partially receive a plug that terminates the insulated conductors of the first data cable, and a plurality of wire connection locations for at least partially receiving respective ones of the insulated conductors of the second data cable; and (b) a screen connector for shielding contacts of the electrical connector from external electromagnetic interference, the plurality of electrically conductive contacts comprising:

(1) bifurcate contact arms extending from a common section of the contact, an open end section of the contact arms being adapted to receive an end section of the insulated conductor, pierce the insulation and effect electrical connection therewith, and (2) a fastener for electrically coupling the contact to the track of the printed circuit board, the arms including torsion inhibitors that resiliently inhibit movement of the arms about respective axes when the insulated conductor is forced therebetween, wherein the plurality of electrically conductive contacts open into said wire connection locations, and wherein the screen connector includes an electrically conductive cable engaging member; an electrically conductive insulation displacement contact (IDC) member; and an electrically conductive socket member, the cable engaging member, the IDC member and the socket member being in electrical communication.

* * * * *